US009166290B2

(12) United States Patent
Blech

(10) Patent No.: US 9,166,290 B2
(45) Date of Patent: Oct. 20, 2015

(54) DUAL-POLARIZED OPTICALLY CONTROLLED MICROWAVE ANTENNA

(71) Applicant: Sony Corporation, Tokyo (JP)

(72) Inventor: Marcel Blech, Herrenberg (DE)

(73) Assignee: Sony Corporation, Tokyo (JP)

( * ) Notice: Subject to any disclaimer, the term of this patent is extended or adjusted under 35 U.S.C. 154(b) by 398 days.

(21) Appl. No.: 13/708,233

(22) Filed: Dec. 7, 2012

(65) Prior Publication Data

US 2013/0162490 A1 Jun. 27, 2013

(30) Foreign Application Priority Data

Dec. 21, 2011 (EP) ..... 11194771

(51) Int. Cl.
*H01Q 19/06* (2006.01)
*H01Q 3/26* (2006.01)
*H01Q 15/00* (2006.01)

(52) U.S. Cl.
CPC ..... *H01Q 3/2676* (2013.01); *H01Q 15/002* (2013.01)

(58) Field of Classification Search
CPC ..... H01Q 15/002; H01Q 3/2676
USPC ..... 343/754, 753, 755, 772, 776, 786
See application file for complete search history.

(56) References Cited

U.S. PATENT DOCUMENTS 5,579,015 A * 11/1996 Collignon ..... 342/375
6,356,241 B1 3/2002 Jaeger et al.
6,621,459 B2 9/2003 Webb et al.
2008/0238795 A1* 10/2008 Alamouti et al. ..... 343/768
2010/0060521 A1 3/2010 Hayes et al.
2011/0175771 A1 7/2011 Raney
2012/0002973 A1* 1/2012 Bruzzi et al. ..... 398/116
2013/0009851 A1* 1/2013 Danesh ..... 343/904

FOREIGN PATENT DOCUMENTS

WO WO 2012/100885 A1 8/2012

OTHER PUBLICATIONS

Moon-Hee Chung et al., "Development of a Dual-Circular Polarizer for the KVN Receivers", J. Astron. Space Sci., vol. 26, No. 3, 2009, http://www.janss.kr/Upload/files/JASS/OJOOBS_2009_v26n3_345.pdf, pp. 345-354.

(Continued)

*Primary Examiner* — Hoanganh Le
(74) *Attorney, Agent, or Firm* — Oblon, McClelland, Maier & Neustadt, L.L.P.

(57) ABSTRACT

An optically controlled microwave antenna that reduces the optical power consumed by the antenna and to enable polarimetric detection an optically controlled microwave antenna comprises an antenna array and a feed for illuminating said antenna array with and/or receiving microwave radiation. The antenna array comprises a plurality of antenna elements each including a waveguide, two optically controllable semiconductor elements arranged within the waveguide in front of the light transmissive portion of the second end portion, a controllable light source arranged at or close to the light transmissive portion of the second end portion for projecting a controlled light beam onto said semiconductor element for controlling its material properties, and a septum arranged within the waveguide in front of the light transmissive portion of the second end portion and separating said waveguide into two waveguide portions.

26 Claims, 13 Drawing Sheets

(56) References Cited

OTHER PUBLICATIONS

John Huang et al., "Reflectarray Antennas", New York, NY, USA: Institute of Electrical and Electronics Engineers IEEE Press, 2008, 233 Pages.
M. Hajian et al., "Electromagnetic Analysis of Beam-Scanning Antenna at Millimeter-Wave Band Based on Photoconductivity Using Fresnel-Zone-Plate Technique", IEEE Antennas and Propagation Magazine, vol. 45, No. 5, Oct. 2003, pp. 13-25.
Karsten Kuhlmann et al., "Circularly Polarized Substrate-Integrated Waveguide Antenna Array at Ka-Band", Proc. of German Microwave Conference 2008, Hamburg, Germany, Mar. 2008, pp. 471-474.
U.S. Appl. No. 13/980,465, filed Jul. 18, 2013, Blech.
U.S. Appl. No. 13/706,853, filed Dec. 6, 2012, Blech.

* cited by examiner

DUAL-POLARIZED OPTICALLY CONTROLLED MICROWAVE ANTENNA

CROSS-REFERENCE TO RELATED APPLICATION

The present application claims the benefit of the earlier filing date of EP 11194771.9 filed in the European Patent Office on Dec. 21, 2012, the entire content of which application is incorporated herein by reference.

BACKGROUND

1. Field of the Disclosure

The present invention relates to an optically controlled microwave antenna. Further, the present invention relates to an antenna array, in particular for use in such an optically controlled antenna, comprising a plurality of antenna elements. Still further, the present invention relates to control circuit for controlling light sources of an antenna array of a microwave antenna.

2. Description of Related Art

In millimeter wave imaging systems a scene is scanned in order to obtain an image of the scene. In many imaging systems the antenna is mechanically moved to scan over the scene. However, electronic scanning, i.e. electronically moving the radiation beam or the sensitivity profile of the antenna, is preferred as it is more rapid and no deterioration of the antenna occurs like in a mechanic scanning system.

Reflectarray antennas are a well-known antenna technology, e.g. as described in J. Huang et J. A. Encinar, Reflectarray Antennas, New York, N.Y., USA: Institute of Electrical and Electronics Engineers, IEEE Press, 2008, used for beam steering in the microwave and millimeter waves frequency range (hereinafter commonly referred to as "microwave frequency range" covering a frequency range from at least 1 GHz to 30 THz, i.e. including mm-wave frequencies). For frequencies up to 30 GHz there exist multiple technologies to control the phase of each individual antenna element of such a reflectarray antenna having different advantages and disadvantages. In particular PIN diode based switches suffer from a high power consumption, high losses and can hardly be integrated into a microwave antenna operating above 100 GHz. MEMS switches require high control voltages and have very slow switching speed. FET-based switches suffer from high insertion losses and require a large biasing network. Liquid crystal based phase shifters exhibit very slow switching speeds in the order of tenths of a second. Ferroelectric phase shifters allow rapid shifting at low power consumption, but have a significant increase in loss above 60 GHz.

Optically controlled plasmonic reflectarray antennas are described, for instance, in U.S. Pat. No. 6,621,459 and M. Hajian et al., "Electromagnetic Analysis of Beam-Scanning Antenna at Millimeter-Waves Band Based on Photoconductivity Using Fresnel-Zone-Plate Technique", IEEE Antennas and Propagation Magazine, Vol. 45, No. 5, October 2003. Such reflectarray antennas have, however, a very high power consumption. Particularly, U.S. Pat. No. 6,621,459 discloses a plasma controlled millimeter wave or microwave antenna in which a plasma of electrons and holes is photo-injected into a photoconducting wafer. In a first embodiment the semiconductor is switched between the material states "dielectric" and "conductor" requiring a high light intensity and providing a high antenna efficiency. In a second embodiment the semiconductor is switched between the two states "dielectric" and "absorber (lossy conductor)" requiring only a low light intensity and providing a worse antenna efficiency. A special distribution of plasma and a millimeter wave/microwave reflecting surface behind the wafer allows a phase shift of the individual elements of 180° between optically illuminated and non-illuminated elements in the first embodiment. The antenna can be operated at low light intensities using a mm-wave/microwave reflecting back surface with an arbitrary constant phase shift between illuminated and non-illuminated elements in said second embodiment.

In an embodiment the antenna includes a controllable light source including a plurality of LEDs arranged in an array and a millimeter wave reflector positioned in front of the light source, said reflector allowing light from the light source to pass there through while serving to reflect incident millimeter wave radiation. Further, an FZP (Fresnel Zone Plate) wafer is positioned in front of the millimeter wave reflector, said wafer being made a photoconducting material which is transmissive in the dark to millimeter waves and is responsive in the light. Finally, the antenna includes an antenna feed located in front of the wafer for illuminating the wafer with millimeter waves and/or receiving millimeter waves. By selectively illuminating the LEDs, heavy plasma density produces a 180° phase shift in out-of-phase zones. With respect to those regions where the LEDs are not illuminated, low plasma density (or "in-phase") zones are provided. Millimeter wave radiation which is incident on the high plasma density zones incurs a 180° phase change on reflection at the front surface of the wafer. Comparatively, millimeter wave radiation which is incident on the low plasma density zones incurs a 180° phase change on reflection at the millimeter wave reflector. The path length difference provides the desired overall phase shift of 180° between in-phase and out-of-phase zones. In an alternative embodiment described in this document the reflectivity of the wafer to reflect millimeter wave radiation is changed by the illumination of the light source to either allow the millimeter wave radiation to be reflected or to pass through. In another embodiment using lower light intensities the mm-wave radiation can either be absorbed by the wafer or pass through.

The "background" description provided herein is for the purpose of generally presenting the context of the disclosure. Work of the presently named inventor(s), to the extent it is described in this background section, as well as aspects of the description which may not otherwise qualify as prior art at the time of filing, are neither expressly or impliedly admitted as prior art against the present invention.

SUMMARY

It is an object of the present invention to provide an optically controlled microwave antenna having a lower power consumption compared to known optically controlled microwave antennas and providing the ability to obtain more information out of a radar image. It is a further object of the present invention to provide a corresponding antenna array for use in such an optically controlled microwave antenna.

According to an aspect of the present invention there is provided an optically controlled microwave antenna comprising:

i) an antenna array comprising a plurality of antenna elements, an antenna element comprising:

a waveguide for guiding microwave radiation at an operating frequency between a first open end portion and a second end portion arranged opposite the first end portion, said second end portion having a light transmissive portion formed in at least a part of the second end portion, two optically controllable semiconductor elements arranged within the waveguide in front of the light transmissive portion of the second end portion, each of said semiconductor element changing its material properties, in particular its reflectivity of microwave radiation of the operating frequency, under control of incident light, a controllable light source arranged at or close to the light transmissive portion of the second end portion for projecting a controlled light beam onto said semiconductor element for controlling its material properties, in particular its reflectivity, and a septum arranged within the waveguide in front of the light transmissive portion of the second end portion and separating said waveguide into two waveguide portions, wherein within each waveguide portion one of said two semiconductor elements is arranged, and ii) a feed for illuminating said antenna array with and/or receiving microwave radiation of the operating frequency from said antenna array to transmit and/or receive microwave radiation.

According to a further aspect of the present invention there is provided an antenna array, in particular for use in such an optically controlled antenna, comprising a plurality of antenna elements, an antenna element comprising:

a waveguide for guiding microwave radiation at an operating frequency between a first open end portion and a second end portion arranged opposite the first end portion, said second end portion having a light transmissive portion formed in at least a part of the second end portion, two optically controllable semiconductor elements arranged within the waveguide in front of the light transmissive portion of the second end portion, each of said semiconductor element changing its material properties, in particular its reflectivity of microwave radiation of the operating frequency, under control of incident light, a controllable light source arranged at or close to the light transmissive portion of the second end portion for projecting a controlled light beam onto said semiconductor element for controlling its material properties, in particular its reflectivity, and a septum arranged within the waveguide in front of the light transmissive portion of the second end portion and separating said waveguide into two waveguide portions, wherein within each waveguide portion one of said two semiconductor elements is arranged.

Preferred embodiments of the invention are defined in the dependent claims. It shall be understood that the claimed antenna array has similar and/or identical preferred embodiments as the claimed optically controlled microwave antenna and as defined in the dependent claims.

To gain the most information out of a radar image, polarimetry can be employed. Targets converting the polarization during scattering or being invisible for a solely linear polarized radar system can be detected. By evaluating the way the target is scattering, a more detailed picture can be obtained showing some of the scattering properties of the observed targets (e.g. rough surface, lattice, parallel wires, . . . ).

In order to apply polarimetric picture processing, the transmit (TX) and receive (RX) antennas emit and receive the electromagnetic field in a dual-polarized manner, i.e. dual-polarized elements with orthogonal polarization is used. Orthogonal polarizations can either be linear vertical and linear horizontal (or linear in any orientation and the perpendicular polarization), left-hand circular and right-hand circular, or orthogonally elliptical (left-hand elliptical and right-hand elliptical with orthogonal orientation of the ellipse). The elliptical case is the most general case and can cover all aforementioned cases, which are special embodiments of the elliptical one.

Polarimetric evaluation of a radar image can be applied to any of the aforementioned orthogonal polarizations. In polarimetry they are even equivalent as by basis transformation the respective receive signals of either combination can be transformed to another by mathematical means. The proposed microwave antenna can be used for scanning a scene in a polarimetric manner using left/right hand circular polarization. Orthogonal linear polarization can also be employed, but with a potential loss of full polarimetric scanning capability.

In order to generate orthogonal polarized waves in a two-dimensional reflectarray antenna, the proposed antenna array and the proposed antenna comprising such an antenna array are configured such that the waveguides are divided into two waveguide portions by a septum. Each of the waveguide portions is terminated by a photosensitive element for phase shifting, a backshort, and some optics for illumination. The septum converts a port signal fed at only one of the virtual waveguide ports of one (e.g. rectangular) waveguide portion to a circularly (elliptically) polarized wave radiated from the (e.g. quadratic) waveguide.

Further, the present invention is based on the idea to reduce the optical power, which is needed to illuminate the optically controllable semiconductor element used to generate a phase shift in the respective antenna element, by use of an antenna array comprising a plurality of antenna elements in which the antenna elements comprise an open-ended waveguide in which the microwave radiation is guided between a first open end portion and a second end arranged opposite the first end. In the vicinity of said second end portion, which is at least partially open, the optically controllable semiconductor element is placed, preferably in the form of a narrow post (or a grid array of posts as explained below), which semiconductor element changes its material properties, in particular its reflectivity for microwave radiation at the operating frequency, under control of incident light.

For instance, the semiconductor elements may be made of intrinsic semiconductor material, causing a full reflection in case of being illuminated and leading to a change of conductivity from almost 0 S/m to more than 1000 S/m. For illumination of the semiconductor elements controllable light sources are arranged at or close to the light transmissive portion, in particular an opening (or and indium tin oxide layer) of the second end portion of the waveguide, for projecting a controlled light beam onto said semiconductor elements for controlling their reflectivity. As in the known optically controlled microwave antennas such light sources may, for instance, be LEDs, laser diodes, solid state lasers or other means for emitting optical light (visible, IR, or UV) beam.

Like in the known optically controlled microwave antennas a feed is provided for illuminating the antenna array with microwave radiation of the operating frequency to transmit microwave radiation, e.g. for illuminating a scene in an active radiometric imaging system and/or for receiving microwave radiation of the operating frequency from said antenna array to receive microwave radiation, e.g. reflected or emitted from a scene scanned by a (active or passive) radiometric imaging system.

In a preferred embodiment said feed is configured to illuminate said antenna array with and/or to receive microwave radiation from said antenna array, said radiation having one or two different polarizations, in particular having one or two different linear polarizations, circular polarization or elliptical polarizations. In other words the entire antenna can either be operated in full polarimetric mode, in which the orthogonal receive signals are acquired in left/right hand circular polarization at the same time. Alternatively the antenna can be operated in either linear or vertical linear polarization, which only allows acquisition of the copolarization elements of the polarimetric scattering matrix in a sequential manner assuming the scene is static or quasi-static.

It shall be understood that according to the present invention the antenna may be used generally in the frequency range of millimeter waves and microwaves, i.e. in at least a frequency range from 1 GHz to 30 THz. The "operating frequency" may generally be any frequency within this frequency range. When using the term "microwave" herein any electromagnetic radiation within this frequency range shall be understood.

Further, the expression "light source" shall be understood as any source that is able to emit light for illuminating its associated semiconductor element so as to cause the semiconductor element to change its reflectivity to a sufficient extent. Here, "light" preferably means visible light, but also generally includes light in the infrared and ultraviolet range.

It shall also be noted that the proposed optically controlled microwave antenna and the proposed antenna array may be used as reflectarray antenna, i.e. in which embodiment the incident microwave radiation is reflected to the same side of the antenna array. In another embodiment, however, the antenna and the antenna array may be used as a transmissive array antenna in which embodiment the incident microwave radiation is incident on the antenna array on a different side than the output microwave radiation, i.e. the radiation that is transmitted through the waveguides of the antenna array is used as output in this embodiment. In this case the mm-wave signal of the optically illuminated antenna elements is reflected or absorbed. Thus, the antenna aperture efficiency is only approximately 50% of the aforementioned reflectarray.

In rapid optically controlled microwave antennas the semiconductor elements are generally controlled simultaneously, e.g. by a microcontroller or a field-programmable gate array, preferably by individual control lines. For instance, in the antenna disclosed in U.S. Pat. No. 6,621,459 the LEDs are individually controlled. This results in an overall high current and a static power consumption of the control circuit. For instance, in case each semiconductor element requires a current of 10 mA a total current of 100 A is required in case of 10000 semiconductor elements in the antenna array which is generally not applicable. Hence, in an aspect of the present invention a control circuit is proposed as defined above for controlling the light sources of an antenna array by which the current provided to the individual light sources is reduced to a small fraction of the current used conventionally. Further the total current is strongly reduced resulting in no static power consumption of the control circuit for controlling the light emitting elements such as LEDs or laser diodes.

The control circuit is preferably used in an optically controlled microwave antenna as proposed according to the present invention and/or for controlling the light sources of the proposed antenna array. However, generally the proposed control circuit can also be used in other microwave antennas having an antenna array, such as the antenna described in U.S. Pat. No. 6,621,459, in which the proposed control circuit can also lead to a significant reduction of the static power consumption of the control circuit of the light sources. Furthermore, less interconnects and wires are needed compared to a solution using a flip-flop for each antenna element.

The proposed optically controlled microwave antenna can be scaled to frequencies beyond 500 GHz maintaining low loss (1 dB) and having a reduced power consumption compared to conventional optically controlled microwave antennas, in particular plasmonic reflectarray antennas (80% less).

It is to be understood that both the foregoing general description of the invention and the following detailed description are exemplary, but are not restrictive of the invention.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DESCRIPTION OF THE EMBODIMENTS

Figure 1:
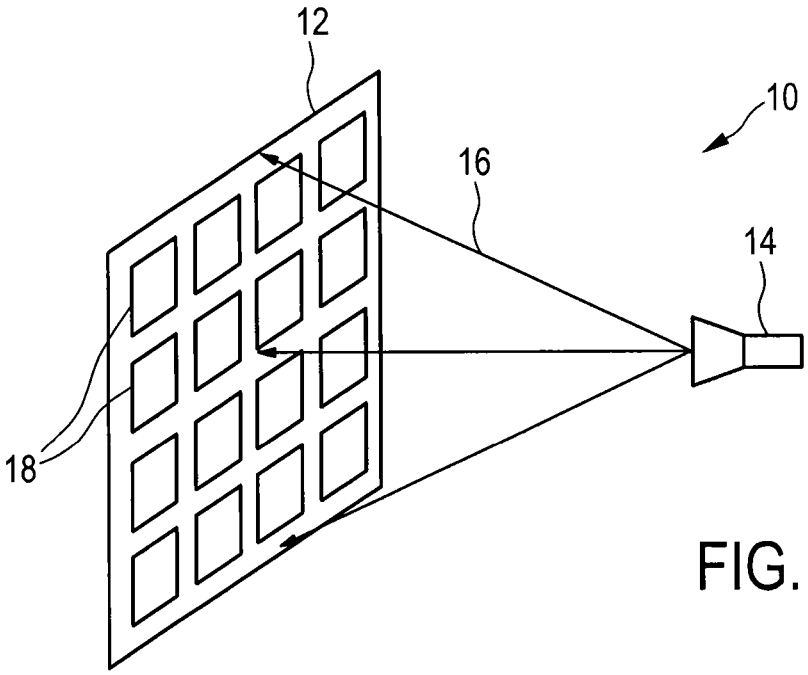
FIG. 1 shows a general embodiment of an optically controlled microwave antenna according to the present invention.

Referring now to the drawings, wherein like reference numerals designate identical or corresponding parts throughout the several views, FIG. 1 shows a general embodiment of an optically controlled microwave antenna 10 according to the present invention. The antenna 10 comprises an antenna array 12 and a feed 14 for illuminating said antenna array with and/or receiving microwave radiation 16 of the operating frequency from said antenna array 12 to transmit and/or receive microwave radiation, for instance to illuminate a scene and/or receive radiation reflected or emitted from a scene to make a radiographic image of the scene. The feed 14 may be a small microwave radiation horn or the like, or may be embodied by a small sub-reflector in case of a Cassegrain or backfire-feed type construction. The feed 14 may be connected (not shown) to a microwave radiation source (transmitter) and/or to a microwave receiver as required according to the desired use of the microwave antenna 10. The antenna array 12 comprises a plurality of antenna elements 18, the reflectivity of which can be individually controlled as will be explained below so that the total antenna beam reflected from or transmitted through the antenna array can be electronically steered to different directions as needed, for instance, to scan a scene. Particularly, the phase of reflected or transmitted microwave radiation of the individual antenna elements 18 can be individually controlled.

Figure 2:
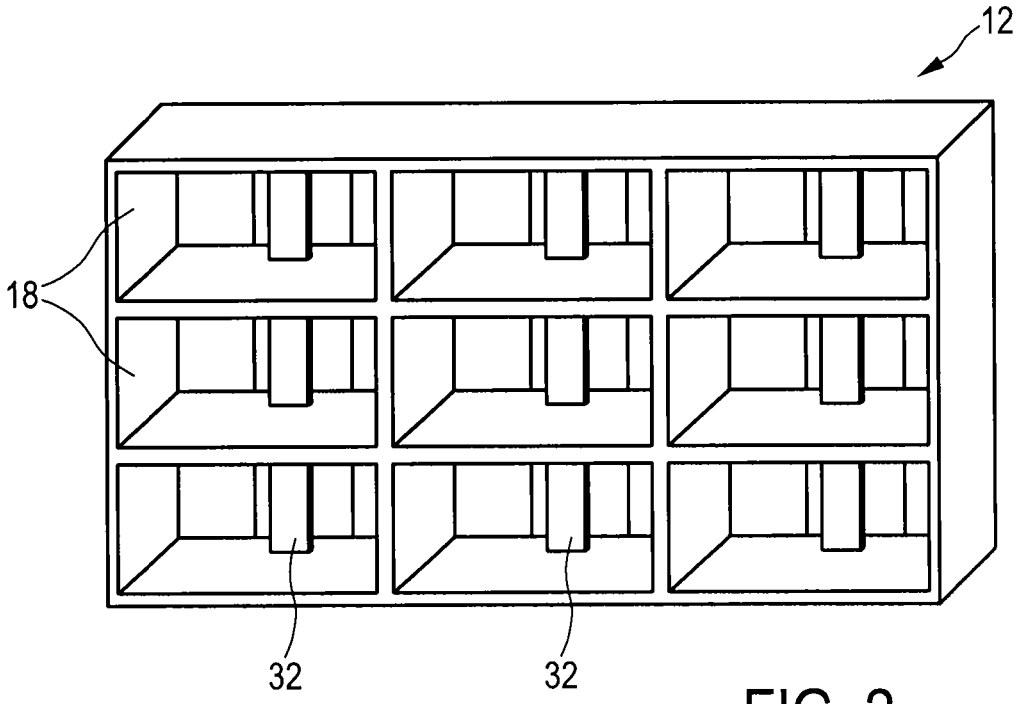
FIG. 2 shows an embodiment of an antenna array.
Figure 3:
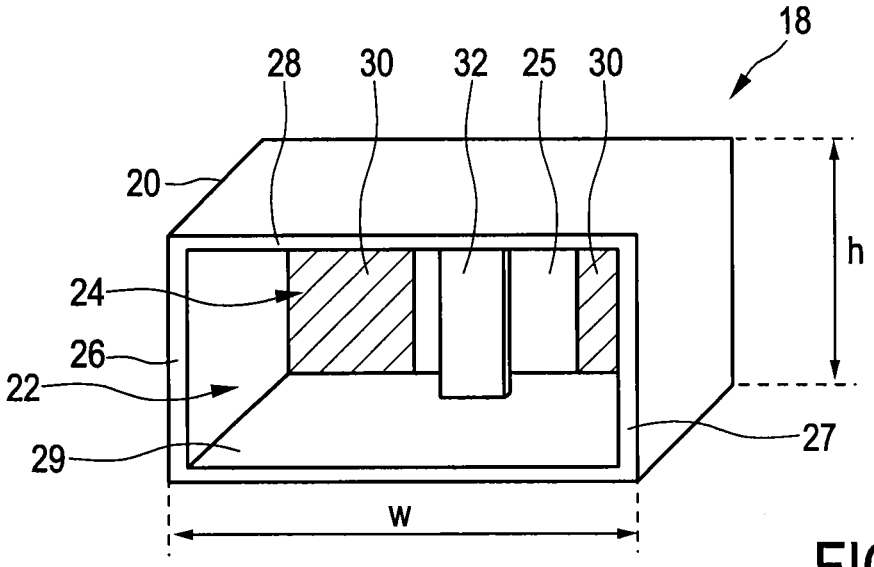
FIG. 3 shows a perspective view of a single antenna element of such an antenna array.

In the embodiment shown in FIG. 1 the antenna elements 18 are regularly arranged along rows and columns of a rectangular grid, which is preferred. However, other arrangements of the antenna elements 18 of the antenna array 12 are possible as well. A perspective view of an antenna array 12 that may be used in an antenna 10 shown in FIG. 1 is depicted in FIG. 2. A single antenna element 18 is depicted in FIG. 3 in a perspective view. The antenna element 18 comprises a waveguide 20 for guiding microwave radiation at an operating frequency between a first open end portion 22 and a second end portion 24 arranged opposite the first end portion 22, said second end portion 24 having an opening 25 (generally a light transmission portion) formed in at least a part of the second end portion 24. The antenna array 12 is preferably arranged such that the first open end portion 22 is facing the feed 14. Preferably, the rectangular waveguide 20 is operated in its fundamental $TE_{10}$ mode.

The waveguide 20 is formed in this embodiment by a tube-like waveguide structure having two opposing left and right sidewalls 26, 27, two opposing upper and lower sidewalls 28, 29 and a back end wall 30, which sidewalls 26 to 30 are preferably made of the same metal material configured to guide microwave radiation.

The antenna element 18 further comprises an optically controllable semiconductor element 32, preferably formed as a post, arranged between and contacting the opposing upper and lower sidewalls 28, 29 of the waveguide 20. The semiconductor element 32 is arranged within the waveguide 20 in front of the opening 25 of the second end portion 24, preferably at a predetermined distance from said opening 25 and closer to said second end portion 24 than to said first end portion 22. Said semiconductor element 32 is configured to change its material properties from dielectric to conductor under control of incident light. For instance, in an embodiment said semiconductor element is able to cause a full reflection within the waveguide 20 in case it is illuminated and to cause no or only low reflection (e.g. full transmission) in case it is not illuminated, i.e. the total reflection changes under control of incident light. Preferably said semiconductor element 32 is made of a photo-conducting material such as elemental semiconductors including silicon and germanium, another member of the category of III-V and II-VI compound semiconductors or graphene.

It should be noted that, while the semiconductor element herein is shown as having the form of a post, the semiconductor element may also have alternative geometries as long as it fulfills the desired function as described herein. Sometimes such an element is also referred to as a controllable short.

Figure 4:
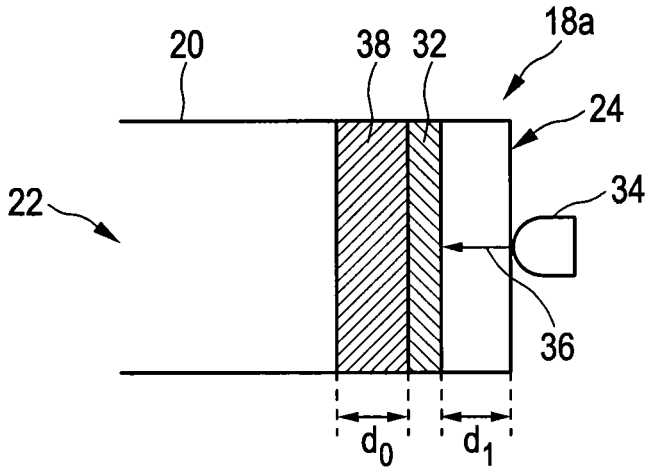
FIG. 4 shows a side view of a first embodiment of a single antenna element.
Figure 5:
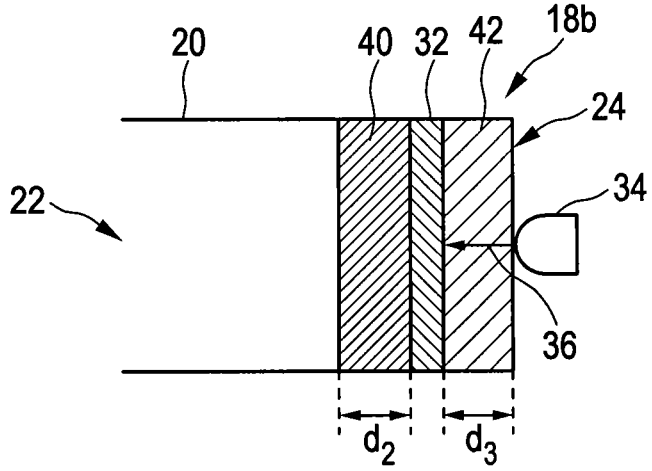
FIG. 5 shows a side view of a second embodiment of a single antenna element.

The antenna element 20 further comprises (not shown in FIGS. 2 and 3 but in FIGS. 4 and 5 showing side views of different embodiments of antenna elements 18*a*, 18*b*) a controllable light source 34 arranged at or close to the opening 25 of the second end portion 24 for projecting a controlled light beam 36 through said opening 25 onto said semiconductor element 32 for controlling its material properties. Due to the change of the material properties of the semiconductor material, the entire antenna element will change the phase of the reflected signal. Said light source 34 may be an LED or a laser diode, but may also include an IR diode or a UV light source in case the semiconductor element 32 is configured accordingly to change its reflectivity in response to incident IR or UV light.

As shown in FIG. 2 the antenna elements 18 are arranged next to each other so that they are sharing their sidewalls. Preferably, the waveguides 20 have a rectangular cross-section having a width w (between the left and right sidewalls 26, 27) of substantially a half wavelength ($0.5\lambda<w<0.9\lambda$) and a height h (between the upper and lower sidewalls 28, 29) of substantially a quarter wavelength ($0.25\lambda<h<0.452$) of the microwave radiation of the operating frequency. By use of such a dimensioning of the waveguide 20 it is made sure that only the fundamental $TE_{10}$ mode of the microwaves is guided through the waveguide 20. Further, since only the fundamental $TE_{10}$ mode can propagate within the waveguide, it can be assured that the radiation pattern always looks the same, independent from how homogenous the semiconductor element 32 is illuminated.

As shown in the side view of FIG. 4 the semiconductor element 32 is preferably arranged at a distance $d_1$ from the second end portion 24 of substantially a guided quarter wavelength ($\lambda_g/4$) of the microwave radiation of the operating frequency in case the signal is reflected at the back short of the waveguide. To fix the semiconductor element 32 a support element 38, e.g. a support layer, of a low loss air-like material (e.g. Rohacell) with $\in_r \approx 1$ is used. Generally, the thickness $d_0$ of the support element is not essential as long as the losses are negligible, it could e.g. in the same range as the distance $d_1$. Said support element 38 can, as shown in FIG. 4, be arranged on the side of the semiconductor element 32 facing the first end portion 22 but could also be arranged on the side facing the second end portion 24 if it is optically translucent. Preferably, said support element 38 is arranged (contacted) between the upper and lower sidewalls 28, 29 of the waveguide 20.

Alternatively or in addition to the support element 38 one or more antireflection elements 40, 42, for instance dielectric antireflection layers, may be arranged on one or both sides of the semiconductor element 32 as shown in the embodiment of the antenna element 18*b* shown in FIG. 5. Said antireflection elements 40, 42 preferably have a thickness $d_2$, $d_3$ of substantially a guided quarter wavelength ($\lambda_g/4$) of the microwave radiation of the operating frequency and serve to reduce any losses caused by any mis-match of the semiconductor material. While the antireflection element 40 only needs to be translucent for the microwave radiation, the antireflection layer 42 additionally needs to be translucent for the light 36 emitted by the light source 34.

Generally, it has shown that 20% of the width of the waveguide 20 is a reasonable size for the width of the semiconductor element 32. In this way the overall power can be reduced by approximately 80%. Generally, the width of the semiconductor element 32 is in the range from 5% to 50%, in particular from 10% to 30% of the width w of the waveguide 20.

The opening 25 of the end portion 24 of the waveguide 20 preferably takes at a portion of 5% to 75%, in particular of 10% to 50%, of the total end area of the second end portion 24. The size of the opening 25 depends on the type of application of the antenna array. If the antenna array 12 shall be used as a reflectarray the opening 25 must not be too large so that microwaves transmitting through the semiconductor element 32 in the non-illuminated state are reflected at the back end wall 30 and are not completely transmitted through the waveguide 20.

If, however, the antenna array 12 shall be used as a transmissive array a waveguide-to-microstrip transition and a microstrip-to-waveguide transition are employed (see the embodiment depicted in FIG. 7E that will be explained below). Then, in one state the microwaves are reflected or absorbed by the semiconductor element 32 placed in the microstrip line. In this case only 50% of the energy is transmitted, i.e. the antenna aperture efficiency is reduced by 50%.

In another embodiment, said opening 25 is covered by a light transmissive layer (not shown), such as an indium tin oxide (ITO) layer, provided at the second end portion 24 through which the light 36 emitted from the light source 34 is transmitted onto the semiconductor element 32. The ITO layer reflects the microwaves, i.e. it is a conductor for microwaves and translucent for optical light. Further, the ITO layer covers the complete area of the second end 24, i.e. no back end wall 30 is required, but an optically translucent carrier material is used. This material is outside the waveguide and in front of the light emitting element.

Figure 6:
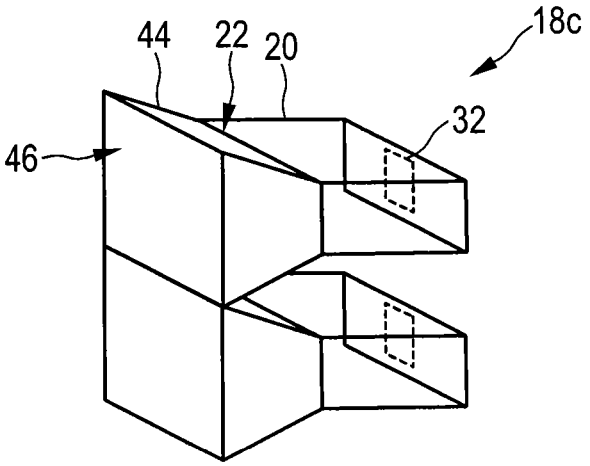
FIG. 6 shows a perspective view of a third embodiment of a single antenna element.

Another embodiment of an antenna element 18*c* is depicted in a perspective view in FIG. 6 (showing two of such antenna elements 18*c*). In this embodiment an aperture element 44, for instance a symmetric quadratic pyramidal aperture, is arranged in front of the first end portion 22 of the waveguide 20 having a larger aperture 46 than the first end portion 22 of the waveguide 20. By this aperture element 44 the incident microwaves are guided into the waveguide 20 having a smaller cross-section so that the semiconductor element 32 can also be made smaller than in the embodiment of the antenna element 18*a*, shown, for instance, in FIG. 3. Consequently, less optical power is required to illuminate the semiconductor element 32 to switch its state of reflectivity so that in total the optical power can be further reduced up to 90% compared to known optically controlled microwave antennas.

Figure 7:
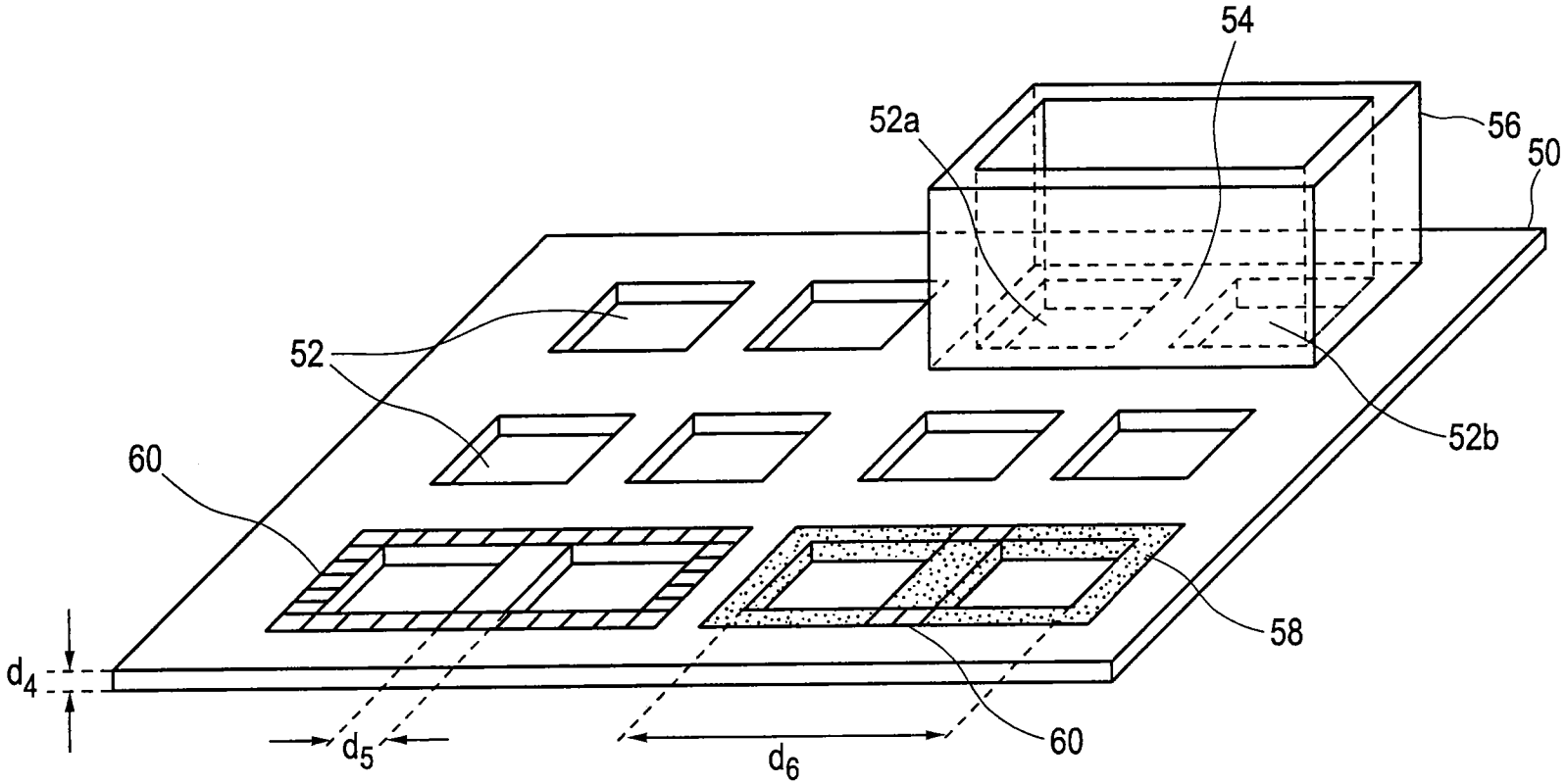
FIG. 7 shows a second embodiment of an antenna array.

A preferred embodiment for manufacturing an antenna array 12 shall be illustrated by way of FIG. 7. This figure depicts a grid 50 made of semiconductor material, in particular made of Si. In said grid 50 holes 52 have been formed, in particular by etching, wherein between two neighboring holes 52*a*, 52*b* a post 54 of said semiconductor material remains, said post 54 representing the semiconductor element 32. Onto said grid 50, preferably on both sides, the waveguides 20 are formed by an array of tubes or tube-like structures having two open ends, wherein said array of tubes is coupled to said grid 50 and arranged such that an open end of a tube 56 covers two neighboring holes 52*a*, 52*b* and the post 54 formed there between.

In an exemplary implementation for 140 GHz the thickness $d_4$ of the grid 50 may be approximately 50 μm, the width $d_5$ of the post 54 may be approximately 300 μm and the width $d_6$ of the two neighboring holes 52*a*, 52*b* including the post 54 may be approximately 1500 μm. Further, in an embodiment a conductive coating 58, e.g. made of gold, may be provided at the inner sidewalls of said holes 52*a*, 52*b* to further improve the ability to guide microwaves within said holes 52*a*, 52*b*. This is only exemplarily shown for two neighboring holes. Further, in an embodiment vias 60 are provided at the top and bottom of the post 54 to continue the walls of the rectangular waveguides 56 put on the top and bottom of the semiconductor grid 50. Instead of using a metal plating, the entire outline of the waveguide can be covered with vias as depicted exemplarily in FIG. 7.

Preferably, the light sources 34 of the antenna array 12 are also arranged in a light source matrix (not shown), in particular on a light source carrier structure. In an embodiment, said light source carrier structure can be easily coupled to the grid 50 and the light sources are arranged in said light source carrier structure with distances corresponding to the distances of the posts 54 in the grid 50.

Figure 8:
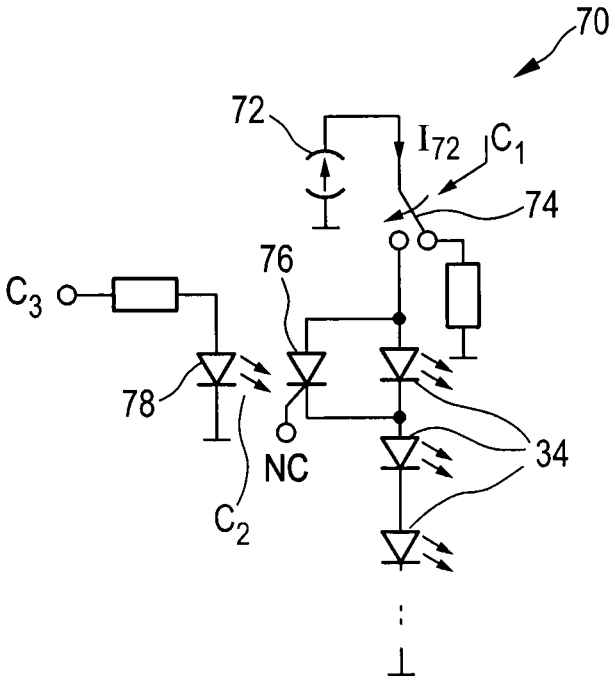
FIG. 8 shows a circuit diagram of a control unit for controlling a light source of an antenna element.

An array of a large number, e.g. 10000, antenna elements (covering, for instance, an area of approximately 10 cm×10 cm at an operating frequency of 140 GHz) requires a large number of control lines if the light sources 34 were individually controlled to illuminate the respective semiconductor elements 32. In principle, each semiconductor element 32 should be controlled individually. Connecting each light source 34 of a light source matrix to an output of a control circuit, such as a microcontroller or FPGA, would result in a high overall current consumption which cannot be handled by the control circuit, Thus, according to an aspect of the present invention a control circuit is provided for controlling light sources of an antenna array, in particular an antenna array as proposed according to the present invention, of a microwave antenna, in particular as proposed according to the present invention. A circuit diagram of a single control unit 70 of such a control circuit is shown in FIG. 8. As shown in the circuit diagram the light sources 34 within a row or column are connected in series and are driven by a current source 72 that, for instance, provides a drive current $I_{72}$ of 10 mA. Said drive current $I_{72}$ can be switched on and off by use of an electronic switch 74 which is switched on and off under control of a first control signal $C_1$ (also called line control signal). By coupling the light sources 34 within a row or column in series and driving them by the common current source 72 the overall current can also be reduced.

In parallel to the individual light sources 34 a switchable element 76 is provided that can be switched on and off under control of a second control signal $C_2$ (also called switching element control signal). When said switchable element 76 is switched on, the light source 34 coupled in parallel is shorted so that the light source 34 is switched off, i.e. does not emit light. The switchable element 76 is preferably formed by a thyristor or a triac, in particular a photo-thyristor or photo-triac.

The second control signal $C_2$ is provided by a switching element 78 which is configured for switching said switchable element 76 on and off. Preferably, said switching element 78 is formed by a diode, in particular an IR diode, and the second control signal $C_2$ is a radiation signal emitted by said diode 78. Said switching element 78 in turn is controlled by a third control signal $C_3$, e.g. provided by a microcontroller or a processor.

Assuming in a practical implementation a voltage drop of 1 to 4 V at each light source 34, the voltage at the top light source of a row or column can sum up to a few 100 volts. A photo-thyristor used as the switchable element 76 allows simple voltage level shifting without a galvanic connection to the control circuitry controlling the switching element 78 running at low voltage. Once switched on, the switchable element 76 remains switched on until the supply current $I_{72}$ is turned off for which purpose the switch 74 is provided which switches the entire row or column on and off.

Figure 9:
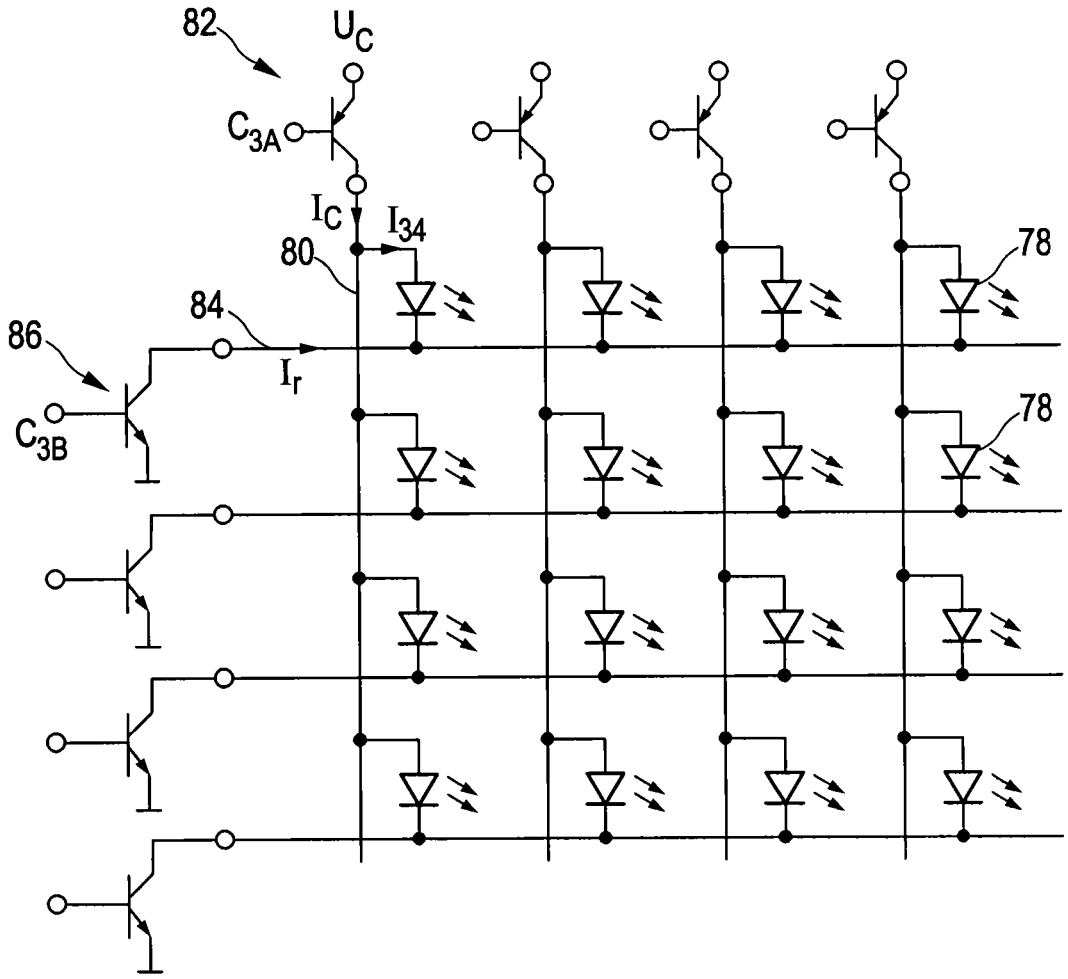
FIG. 9 shows an embodiment of a control circuit for controlling the light sources.
Figure 10:
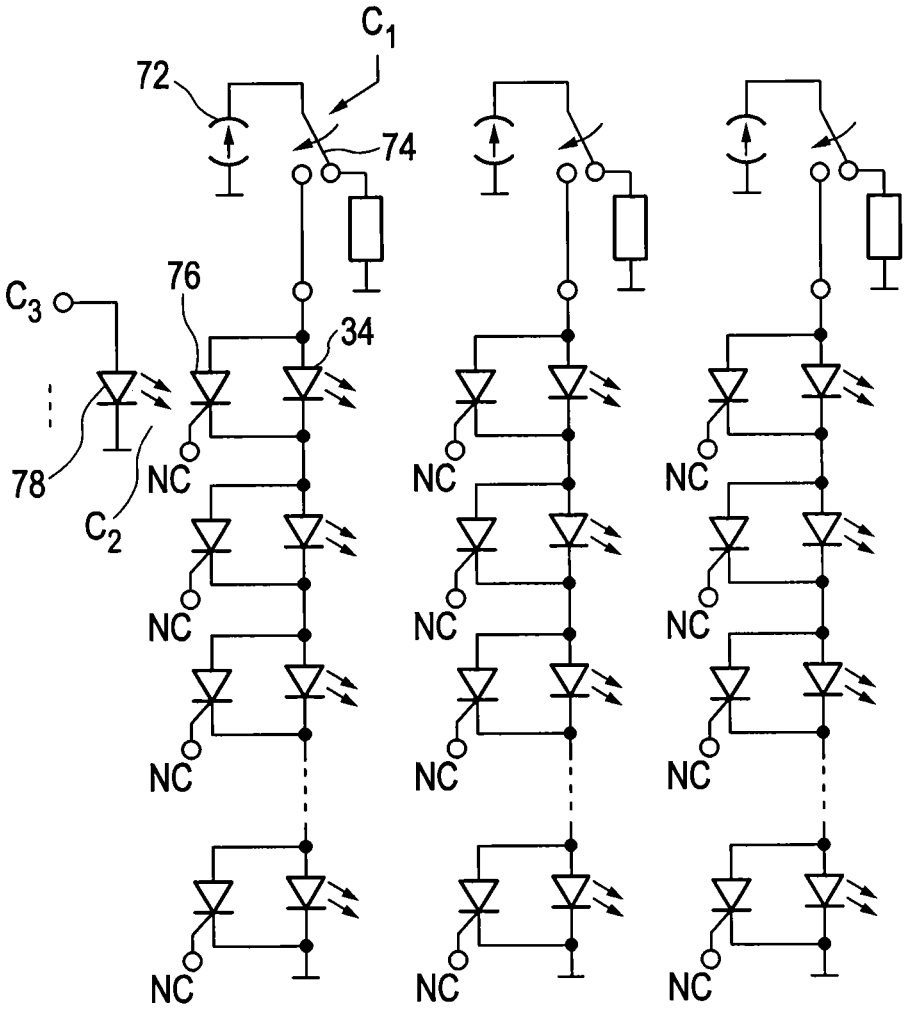
FIG. 10 shows an embodiment of a control circuit for controlling switchable elements coupled in parallel to said light sources.

More details of the proposed control circuit are shown in the circuit diagrams depicted in FIGS. 9 and 10. FIG. 9 shows particularly the control circuitry for providing the light sources 78 with the required optical control signals. As shown in FIG. 9 an array of, for instance, 100×100 light sources 78 are provided as light source matrix, i.e. an array of rows and columns, each light source 78 covering, for instance, an area of 1.5 mm×1.5 mm (at 140 GHz) at maximum. For each column a column control line 80 is provided. To each column a column drive current $I_c$ of e.g. 500 mA is provided through a column switch 82 (e.g. a bipolar transistor) from a voltage source (not shown) providing a column voltage $U_c$ of e.g. 1.5 V. Said column switches 82 are controlled by column control signals $C_{3A}$. Thus, a light source current $I_{34}$ of e.g. 5 mA runs through each light source 78. Further, row control lines 84 are provided through which a row drive current $I_r$ of e.g. 5 mA is fed through a row switch 86 (e.g. a bipolar transistor) which is controlled by a row control signal $C_{3B}$.

FIG. 10 shows the control circuitry for controlling the switchable elements 76 through the switching elements 78 as explained above with reference to FIG. 8. As explained above a single switchable current source 72 drives each column of light sources 78. However, in an embodiment a single current source and a multiplexer can be used for all columns. For each switchable element 76 a switching element 78 controlled by a third control signal $C_3$ is provided.

Considering a particular implementation, FIG. 9 shows a matrix of LEDs 78, which are used to control the photo-thyristors 76. Using a matrix structure reduces the number of outputs of a microcontroller used to configure the matrix. FIG. 10 shows the columns of laser diodes 34 used to illuminate the semiconductor elements. Using a column arrangement can reduce the overall current and the wires used for interconnections. The LEDs 78 control the photo-thyristors 76, which in turn switch the laser diodes 34 on and off. Configuration of the entire array requires a sequential setup of all columns.

Figure 11:
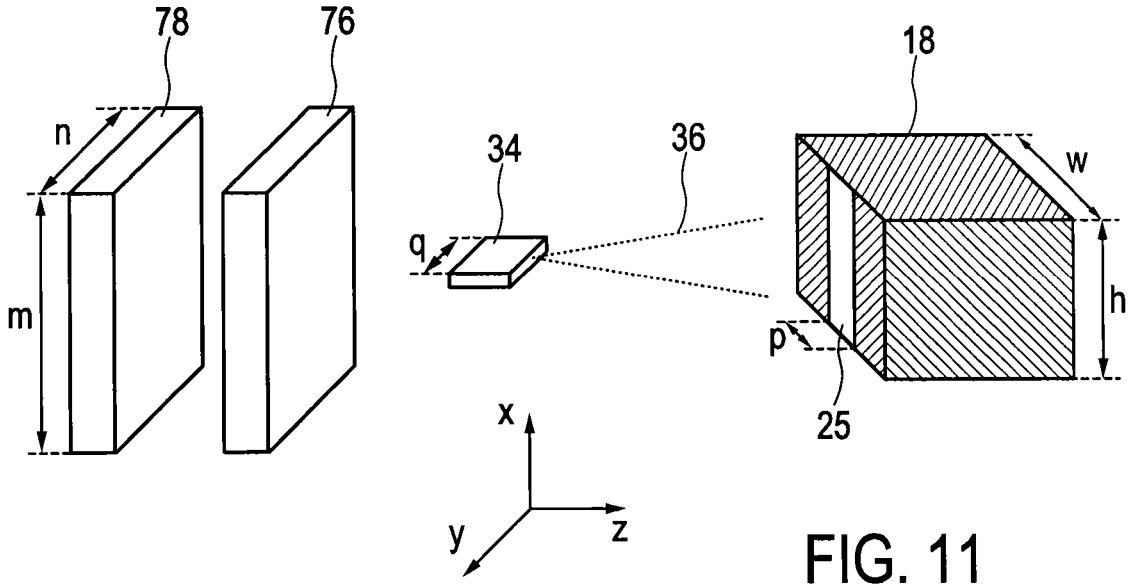
FIG. 11 shows a perspective view of the arrangement of the components of the control unit as shown in FIG. 8.

FIG. 11 schematically shows the arrangement of main components of the control unit 70 shown in FIG. 8. In particular, a light source 34 for emitting a light beam 36 through the opening 25 in the antenna 18 is shown as a side radiating laser diode. Further, the switching element 76 in the form of a photo-thyristor or triac is shown arranged next to the light source 34. The switching element 78, e.g. an IR diode, is arranged next to the switchable element 76. These components are stacked in z-direction and have a maximum size m×n of 1.5 mm×1.5 mm in x-y-direction (typically a size of 1 mm×1 mm) for an operating frequency of 140 GHz, just to give an example. The laser diode 34 has, for instance, a width q of 0.5 mm and the opening 25 has, for instance, a width p of 0.5 mm. The antenna element 18 has, for instance, a height h of 0.75 mm and a width w of 1.5 mm.

Figure 12:
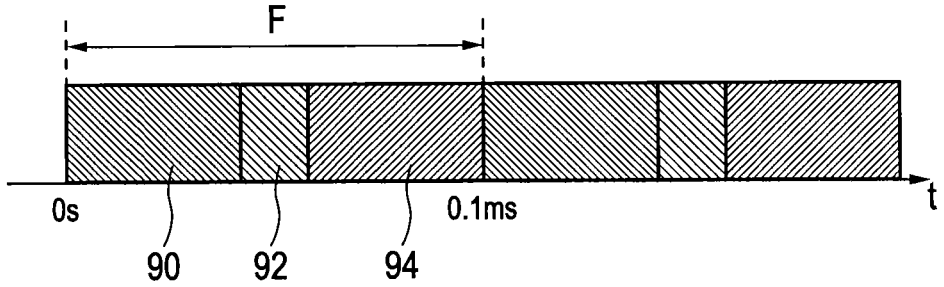
FIG. 12 shows a timing diagram illustrating the control of the light sources.

For proper operation a special control sequence is preferably used as is schematically depicted in the timing diagram of FIG. 12. Said control sequence is also referred to as a frame F. Considering the use of the proposed antenna in an imaging device for imaging a scene, the acquisition of one pixel of an image to be taken starts with a reset phase 90. During this reset phase 90 all switches 74 of all columns/rows are switched off, so that all light sources are switched off. Then, the switches 74 are turned on sequentially and in the setup phase 92 all columns/rows are configured sequentially by the control circuit, which limits the current through the control circuit. For this setup phase a switching element 78 is briefly switched on so that the corresponding light source is briefly switched off. When all light sources or columns/rows are configured, the measurement phase 94 can start during which all light sources have the desired state and the desired data, e.g. for one pixel, can be acquired.

In summary, in the above an optically controlled microwave antenna, in particular a plasmonic reflectarray antenna, has been described in which the reflection (or transmission) of the antenna elements of an antenna array can be controlled by optical illumination of an intrinsic semiconductor which is placed inside an open ended waveguide and represents a reconfigurable short. The phase of the reflected (or transmitted) microwave signal of each semiconductor element can be controlled in a binary manner by switching between 0° and 180°. Compared to known optically controlled microwave antennas the proposed antenna requires approximately 80% to 90% less optical power and has lower losses, in particular below 1 dB. This is particularly achieved since the area which must be illuminated to control the single semiconductor elements is strongly reduced. Further, compared to known antennas comprising a bulk semiconductor, a well-defined radiation pattern can be achieved for each semiconductor element which is beneficial for the total antenna pattern.

Furthermore, according to another aspect a control circuit has been described which reduces the overall current, allows simple voltage level shifting and has no static power consumption.

Those plasmonic reflectarray antennas using open-ended waveguides as individual elements offer lower loss, higher optical efficiency, and lower mutual coupling compared to commonly used solutions employing patch antennas. In order to evaluate all information content contained in the acquired data in a polarimetric fashion, antenna elements exhibiting dual polarization are needed. Up to now no plasmonic reflectarray consisting of open-ended waveguides exists having this feature. Therefore, in the following, based on a modification of the above described antenna and antenna array, a solution is presented to realize a 2D plasmonic reflectarray antenna exhibiting dual polarization. The polarization can either be linear orthogonal or circularly (elliptically) orthogonal. The polarization can also be switched between different states when reflected at the open-ended waveguides. Thus, polarimetric measurements are possible, particularly when operated either with a single linearly polarized feed or a dual-polarized left-/right hand circularly polarized feed.

Figure 13:
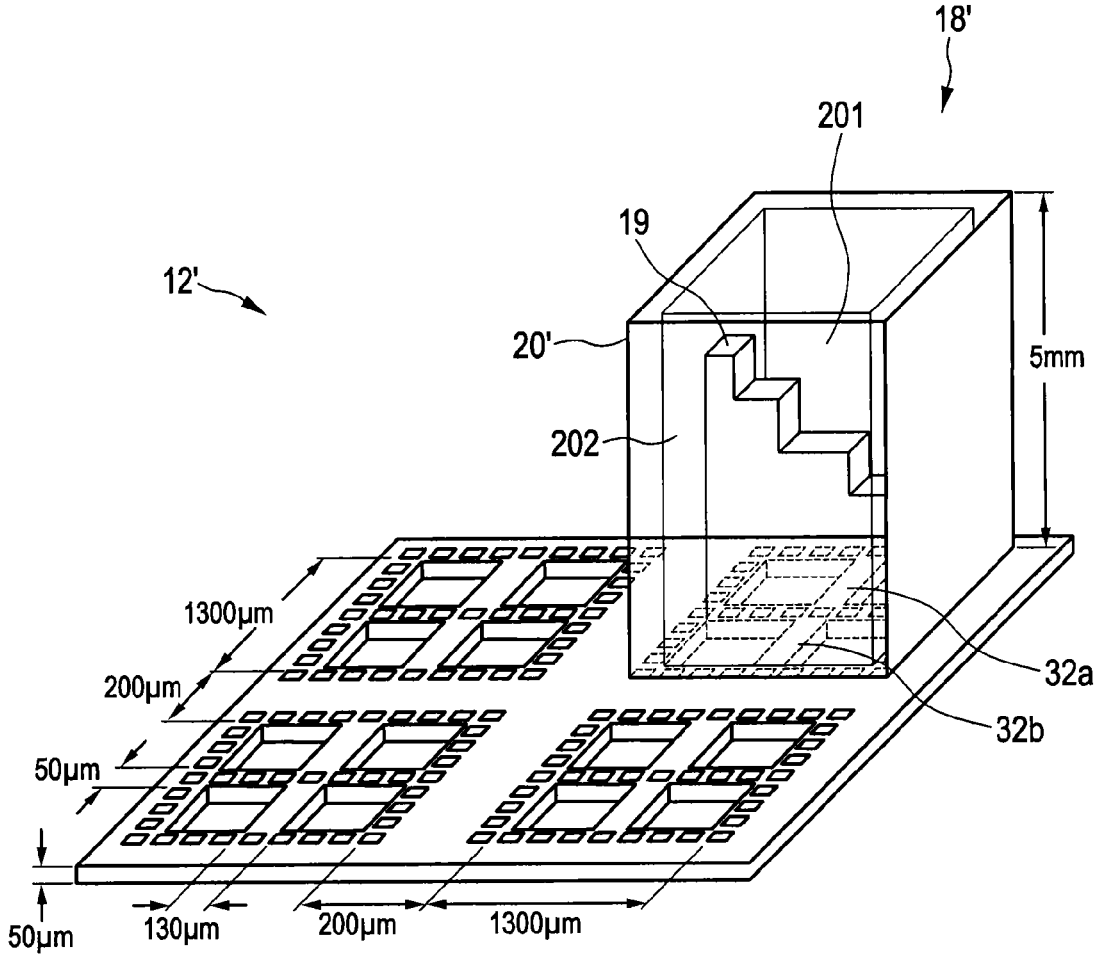
FIG. 13 shows a perspective view of an embodiment of an antenna array according to the present invention.

FIG. 13 shows a perspective view of an embodiment of an antenna array 12' according to the present invention. Compared to the antenna array 12 described above (and e.g. shown in FIG. 7), an antenna element 18' of this antenna array 12' additionally comprises a septum 19 arranged within the waveguide 20' in front of the light transmissive portion of the second end portion of the waveguide 20'. Said septum 19 separates said waveguide 20' into two waveguide portions 201, 202, wherein within each waveguide portion 201, 202 one of two semiconductor elements 32*a*, 32*b* is arranged. Such a septum is generally known in the art, e.g. from R. Behe and P. Brachat, "Compact Duplexer-Polarizer with Semicircular Waveguide," IEEE Trans. On Antennas and Propagation, vol. 39, no. 8, pp. 1222-1224, August 1991.

Figure 14A:
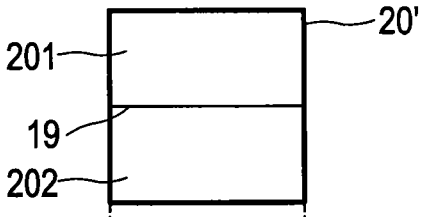
FIG. 14 shows different views of a waveguide including a septum as used in an antenna according to the present invention.
Figure 14B:
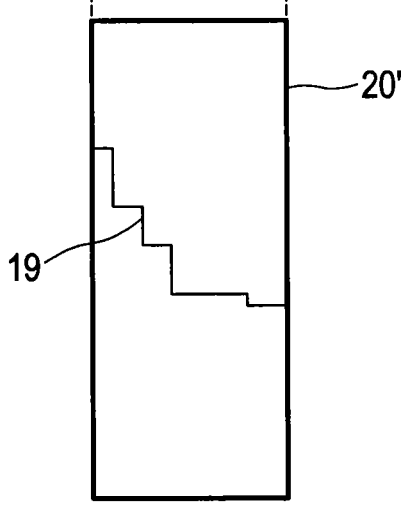

FIG. 14 shows a front view (FIG. 14A) and a cross sectional view (FIG. 14B) of a waveguide 20' of an antenna element 18' according to the present invention. As shown in this embodiment the aperture (FIG. 14A) is made up of quadratic open-ended waveguide 20' instead of rectangular ones as in the above described embodiments. Each of the quadratic waveguides 20' is divided into two rectangular waveguide portions 201, 202 by the septum 19. The septum 19 converts a port signal fed at only one of the virtual rectangular waveguide ports (of a single waveguide portion) to a circularly (elliptically) polarized wave radiated from the quadratic open ended waveguide.

The following table summarizes the function of the septum 19, when virtually feeding the waveguide 20' by either of the rectangular waveguide portions 201, 202 or both rectangular waveguide portions 201, 202 at the same time. In operation the incident wave is reflected at the back short or the photosensitive element, respectively.

| Port 1 phase | Port 2 phase | Resulting polarization |
|---|---|---|
| X | — | Left hand circular |
| — | X | Right hand circular |
| X | X | Linear vertical |
| X | X + 180° | Linear horizontal |

As explained above the reflectarray 12 is fed by a feed horn 14 placed in front of the reflectarray 12. This feed horn 14 can also exhibit different polarizations, e.g. under control of a feed control unit (not shown) for controlling said feed horn 14 to illuminate said antenna array 18' with and/or to receive microwave radiation having a predetermined polarization from said antenna array. The following table lists the overall functionality of the reflectarray (exemplarily for the transmit mode) and the setting of the individual semiconductor elements 32*a*, 32*b* to achieve one-bit phase shifts required for beam steering. For this purpose, configurations included in the same row and exhibiting a phase shift of 180° can be used.

In the following table it can also be observed that by appropriately setting the phase shifts, the linear polarization can be changed from horizontal to vertical or vice versa.

Real polarimetric measurements, which require the transmission of one polarization and the reception of two orthogonal polarizations at the same time, are only applicable for circular polarization. In this case the feed antenna transmits in one circular polarization and both independent left/right hand circular polarized beams of the reflectarray are steered to the same position.

In order to acquire orthogonal linear components of a scene, two sequential measurements are necessary. The beam of the feed antenna transmitting in one linear polarization can be steered using the reflectarray, which may result in either the co- or cross-polarized field of the feed.

| Feed polarization | Virtual port 1 phase | Virtual port 2 phase | Resulting polarization | Resulting phase shift |
|---|---|---|---|---|
| Linear horizontal | X | X | Linear horizontal | 0° |
| | X + 180° | X + 180° | Linear horizontal | 180° |
| | X | X + 180° | Linear vertical | 0° |
| | X + 180° | X | Linear vertical | 180° |
| Linear vertical | X | X | Linear vertical | 0° |
| | X + 180° | X + 180° | Linear vertical | 180° |
| | X | X + 180° | Linear horizontal | 0° |
| | X + 180° | X | Linear horizontal | 180° |
| Left hand circular | X | — | Left hand circular | 0° |
| | X + 180° | — | Left hand circular | 180° |
| Right hand circular | — | X | Right hand circular | 0° |
| | — | X + 180° | Right hand circular | 180° |

Figure 15:
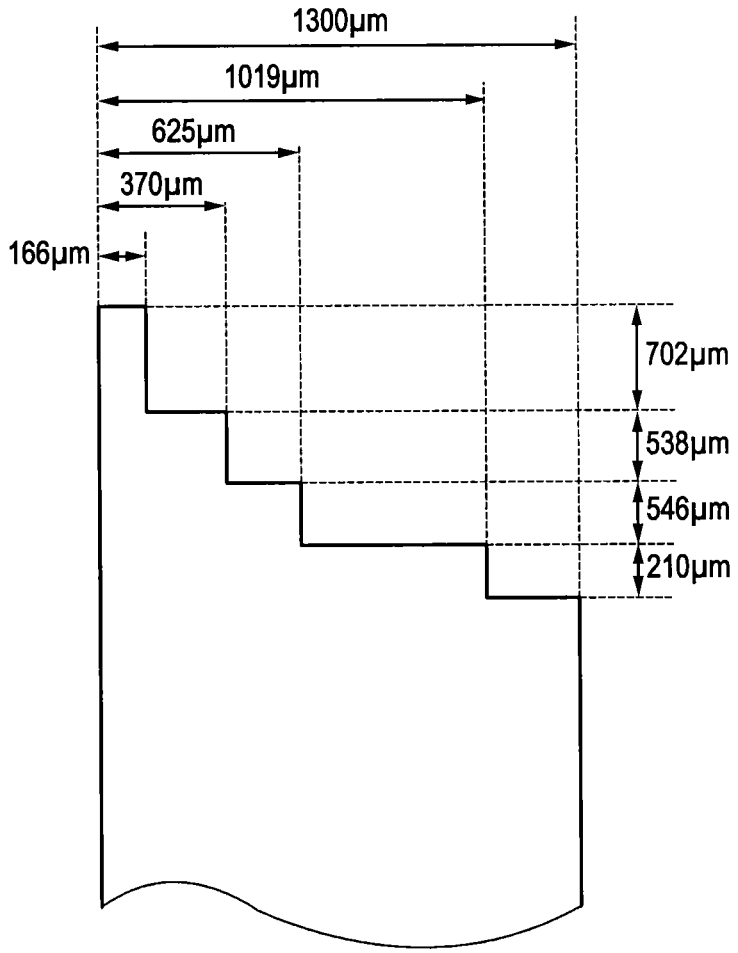
FIG. 15 shows a top view of a septum.

A practical realization, compared to the linear polarized reflectarray antenna, substantially differs in the arrangement of the open ended waveguides and the shape of the top cover. A diagram of the photosensitive thin silicon center layer and one exemplary dual-polarized open ended waveguide 20' is shown in FIG. 13. Typical dimensions are given for an operating frequency of 140 GHz. For instance, the septum 10 has a thickness of 50 μm and the number of sections (steps) is between 3 and 10, typically 5 or 6. The dimensions of the septum can vary and are normally determined by numerical electromagnetic field simulations. As an example it can be referred to FIG. 15 showing an exemplary implementation of a septum 19, where some exemplary numbers are given.

Figure 16:
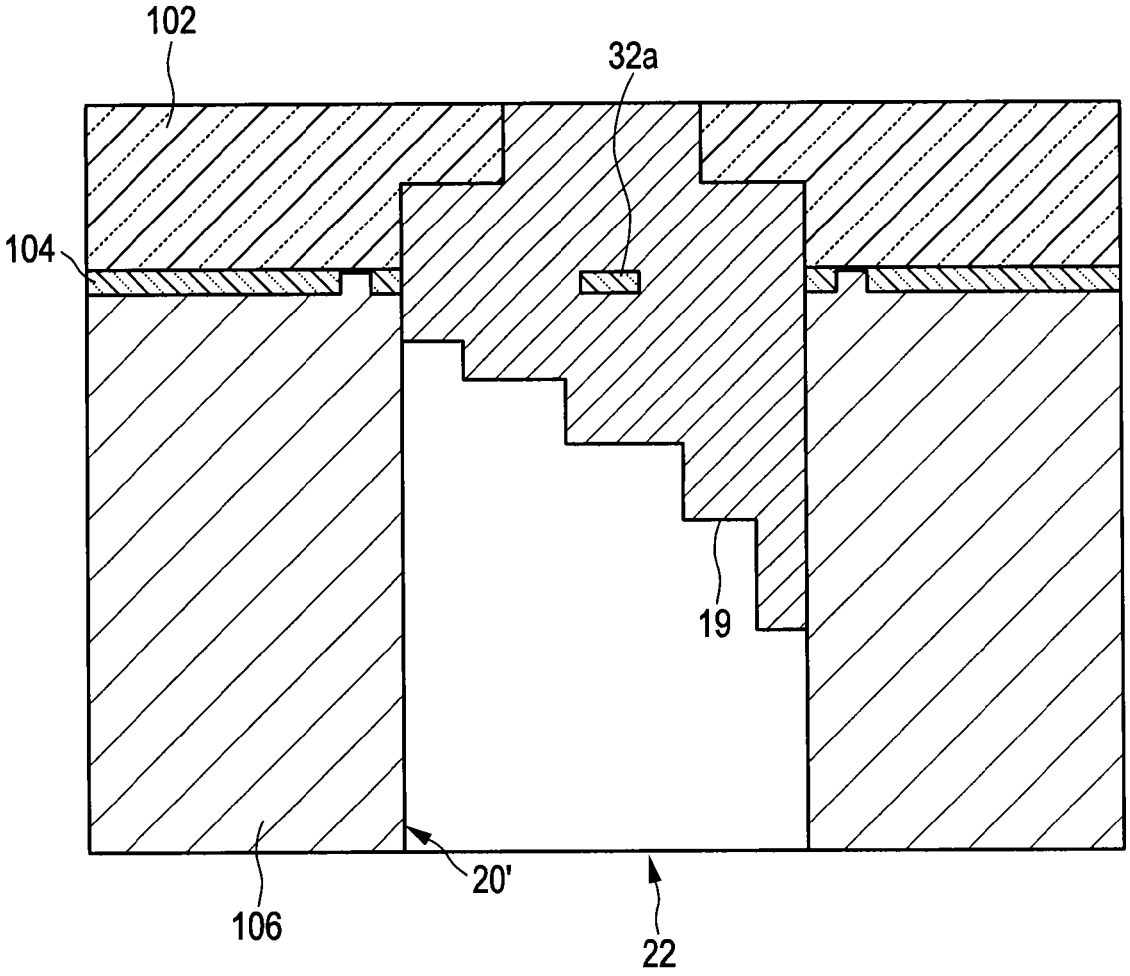
FIG. 16 shows a top view of a single antenna element according to the present invention.

The layer stack-up shown in FIG. 16 is similar to the linear-polarized reflectarray. In the dual-polarized case the thin silicon center layer 104 exhibits vias and a metallization around the outer opening. It is placed on the plane surface of the backshort layer 102. On top of the center layer 104 the open ended waveguide structure is placed, which also contains the septum 19 separating a pair of two rectangular waveguide portions, which together form a quadratic open-ended waveguide 20' on the aperture of the antenna. Due to the length of the septum 19 and the quadratic waveguide section 20', the top layer 106 is typically fabricated by micromolding from a conductive polymer or a polymer, which is coated with some conductive layer (it can also be made of metal or a metallized silicon layer). All layers are preferably bonded together using a conductive adhesive.

As shown in FIG. 14 in each dual-polarized waveguide element 20 two rectangular waveguide portions 201, 202 are stacked upon their small side, so that the overall aperture is quadratic. The rectangular waveguide portion 201, 202 are separated by a septum 19, which converts the linear polarization in either of the rectangular waveguides into a circular (elliptical) polarization in the quadratic waveguide. The attachment and excitation of the photosensitive bar (32*a*, 32*b*) may be in any form as described above for the linear polarized reflectarray elements.

The shape of the cross section of the two stacked waveguide portions 201, 202 can also exhibit other shapes than rectangular (quadratic), for instance a half-circular or half-elliptical cross section is possible for each waveguide portion so that the waveguide has a circular or elliptical cross section.

Furthermore it should be mentioned that the aperture of the individual waveguide portions are not limited to simple open ended waveguides. There can also be pyramidal horns, conical horns or corrugated (scalar) horns employed as explained above. For any of the horns the spacing between the individual open ended waveguide portions becomes larger due to the larger aperture diameter of the horn compared to a solution using only open ended waveguides.

In case of the usage of conical or corrugated horns a waveguide transition from the quadratic to a circular waveguide is needed. The simplest solution is a circular waveguide directly attached to the quadratic waveguide using the same diameter as one side of the quadratic waveguide. More sophisticated solutions employ a long smooth transition, which converts the quadratic cross section continuously into a circular one. However, the simplest approach is using two half-circular waveguides instead of rectangular ones carrying the photosensitive silicon.

Figure 17A:
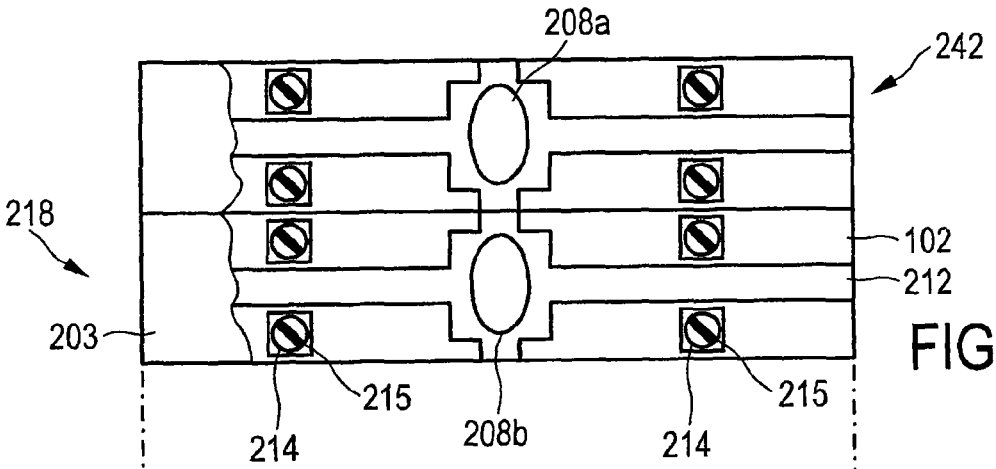
FIG. 17 shows different views of a another embodiment of an antenna array according to the present invention.
Figure 17B:
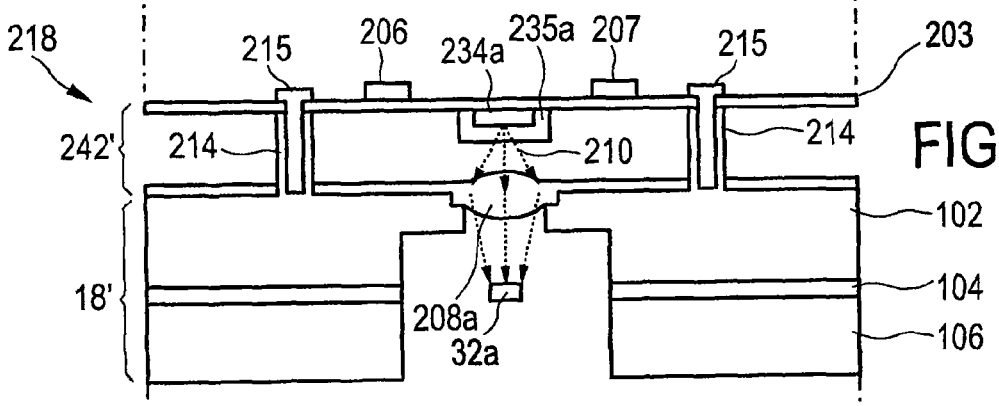
Figure 17C:
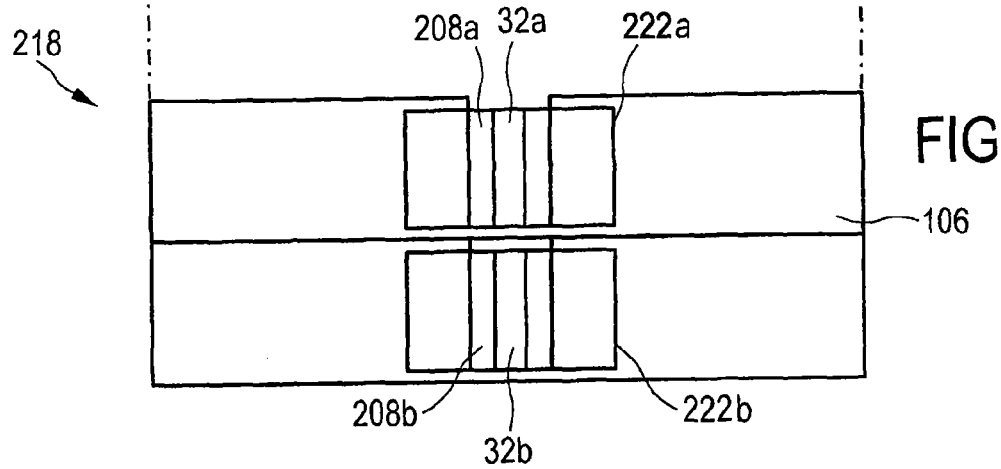

In order to properly illuminate the photosensitive bars, i.e. the semiconductor elements 32*a*, 32*b*, particularly for an antenna array 12' according to the present invention as e.g. shown in FIG. 13, an optical system is employed, which is generally located on the back side of the antenna array 12'. FIG. 17 shows an antenna element 218 of a simple embodiment of an antenna array, wherein FIG. 17A shows a back view of only the illumination unit 242, FIG. 17B shows a cross sectional top view and FIG. 17C shows a front view. The illumination unit 242 of this embodiment of the antenna comprises a printed circuit board (PCB) 203 carrying a two top radiating LEDs (only on LED 234*a* is shown), one for each semiconductor element 32*a*, 32*b*, and some control logic 206 and/or other required electronics 207. On top of each LED 234*a* (preferably with polymer coating 235*a*) a lens 208*a*, 208*b* is placed, which focuses the optical beam 210 onto the respective photosensitive bars 32*a*, 32*b*. The lenses 208*a*, 208*b* can be molded structures forming a grid 212 for the whole array. The illumination unit 242 is coupled to the front part of the antenna element, which may correspond to the part of the antenna element 18' shown in FIG. 13, by use of posts or distance elements 214 and e.g. screws 215. In FIG. 17C the waveguide openings 222*a*, 222*b* of the waveguide portions 201, 202 can be seen. Further, a back short layer 102, a center layer 104 and a top layer 106 are shown in FIG. 17B.

Figure 18A:
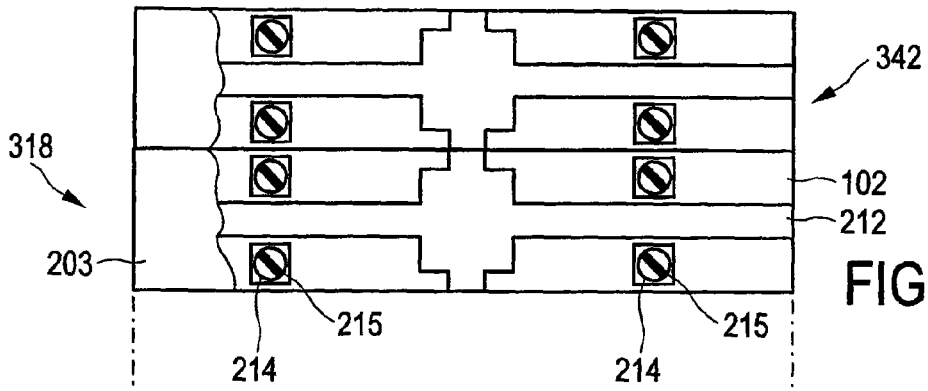
FIG. 18 shows different views of still another embodiment of an antenna array according to the present invention.
Figure 18B:
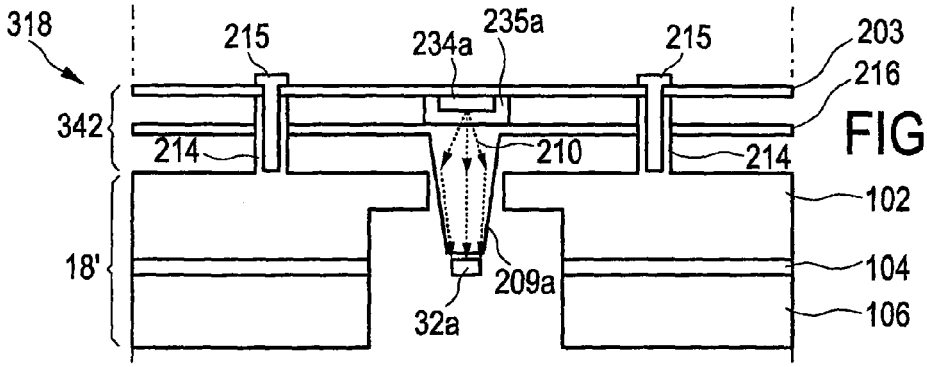
Figure 18C:
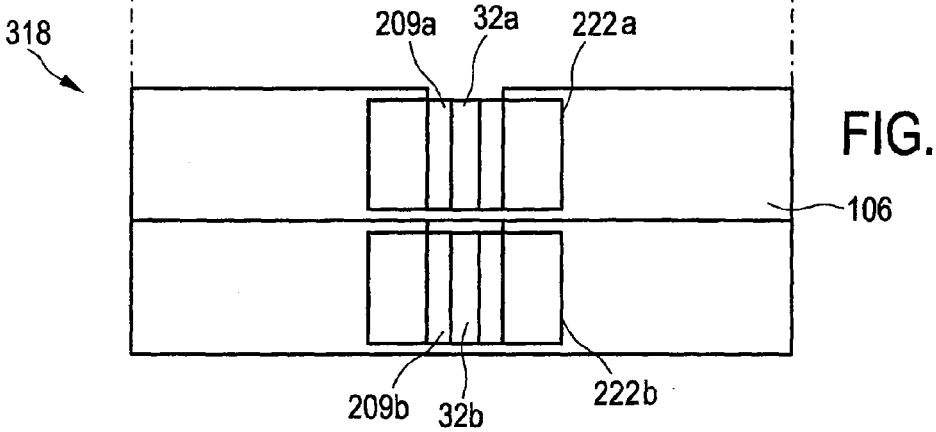

FIG. 18 shows an antenna element 318 of another embodiment of an antenna array, wherein FIG. 18A shows a back view of only the illumination unit 342, FIG. 18B shows a cross sectional top view and FIG. 18C shows a front view. In this embodiment dielectric rods 209*a*, 209*a*, one for each semiconductor element 32*a*, 32*b*, are used as optical guide to focus the optical beam 210 onto the respective center bar 32*a*, 32*b*. Such rods can be molded from a polymer and should end at a short distance before the photosensitive element 32*a*, 32*b*. If they do not touch, mechanical stress can be reduced. The dielectric rods 209*a*, 209*b* are held in this embodiment by a grid or holding bars 216. Further, the LEDs 234*a* and polymer coating 235*a*, respectively, may be glued to the end of the dielectric rods 209*a*, 209*b*. In general, a solution with an optical guide has a higher efficiency than a solution using a lens as shown in FIG. 17. Generally any kinds of optical waveguides may be used as rods 209*a*, 209*b*.

In still another embodiment, based on the embodiment shown in FIG. 18, the entire antenna structure is fabricated out of a single layer. There is no center layer 104. Thus, the photosensitive bars are diced rectangular chips, which are glued with optically translucent adhesive to the tip of the dielectric rods. The rods thus have two functions: they must mechanically hold the photosensitive element and they must guide the optical light from the light source to the photosensitive elements. The antenna structure can be fabricated out of any material, which is electrically conductive or has a conductive coating.

The presented dual-polarized reflectarray allows polarimetric radar measurements by either using a dual polarized feed exhibiting orthogonal left- and right hand circular (elliptical) polarization or a simple linear polarized feed. The latter makes use of the capability of the reflectarray to switch the polarization between two orthogonal states. In this measurement mode both orthogonal linear polarizations must be acquired sequentially. Due to the rapid scanning capability a scenario can be regarded static for the time of the acquisition of both polarizations.

In order to acquire a picture by a mm-wave imaging system a narrow antenna beam is scanned across the scene. Therefore, 2D/3D electronic scanning is desirable. Electronic beam scanning antenna technologies have many further application such as wireless communication systems (to enable a tracking within a mm-wave point-to-point wireless link) or radar tracking applications. Reflectarray antennas have shown to be a powerful means to apply electronic scanning using only a single transmit or receive antenna, Plasmonic reflectarray antennas using open ended waveguides as individual elements offer lower loss, higher optical efficiency, and lower mutual coupling compared to commonly used solutions employing patch antennas.

In summary, according to the present invention a solution to realize a 2D plasmonic reflectarray antenna exhibiting dual polarization is provided. The polarization can either be linear orthogonal or circularly (elliptically) orthogonal. The polarization can also be switched between different states when reflected at the open coded waveguides. Thus polarimetric measurements are possible, when operated either with a single linearly polarized feed or a dual-polarized left-/right hand circularly polarized feed.

The invention can be applied in various devices and systems, i.e. there are various devices and systems which may employ an antenna array, an antenna and/or a control circuit as proposed according to the present invention. Potential applications include—but are not limited to—a passive imaging sensor (radiometer), a radiometer with an illuminator (transmitter) illuminating the scene to be scanned, and a radar (active sensor). Further, the present invention may be used in a communications device and/or system, e.g. for point to point radio links, a base station or access point for multiple users (wherein the beam can be steered to each user sequentially or multiple beams can be generated at the same time, interferers can be cancelled out by steering a null to their direction), or a sensor network for communication among the individual devices. Still further, the invention can be used in devices and systems for location and tracking, in which case multiple plasmonic antennas (at least two of them) should be employed at different positions in a room; the target position can then be determined by a cross bearing; the target can be an active or passive RFID tag). The proposed control circuit can be used to drive any electrical structure, which is arranged as an array, such as e.g. pixels of an LCD display, LEDs, light bulbs, elements of a sensor array (photo diodes).

Obviously, numerous modifications and variations of the present disclosure are possible in light of the above teachings. It is therefore to be understood that within the scope of the appended claims, the invention may be practiced otherwise than as specifically described herein.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

The invention claimed is:

1. An optically controlled microwave antenna comprising:

an antenna array comprising a plurality of antenna elements, each said antenna element including:

a waveguide to guide microwave radiation at an operating frequency between a first open end portion and a second end portion arranged opposite the first end portion, said second end portion having a light transmissive portion formed in at least a part of the second end portion, two optically controllable semiconductor elements arranged within said waveguide, in front of the light transmissive portion of the second end portion, each said optically controllable semiconductor element being configured to change its material properties under control of incident light, the material properties including reflectivity of microwave radiation at the operating frequency, a controllable light source arranged at or adjacent to the light transmissive portion of the second end portion to project a controlled light beam onto each said optically controllable semiconductor element to control the material properties, and a septum arranged within said waveguide, in front of the light transmissive portion of the second end portion, and separating said waveguide into two waveguide portions, wherein within each said waveguide portion one of said two optically controllable semiconductor elements is arranged, and a feed to illuminate said antenna array with and/or to receive microwave radiation at the operating frequency from said antenna array to transmit and/or receive the microwave radiation.

2. The microwave antenna as claimed in claim 1, wherein said waveguide has a quadratic cross section and said septum is arranged to separate said waveguide into said two waveguide portions, each having an identical rectangular cross section.

3. The microwave antenna as claimed in claim 1, wherein said septum has a step profile facing in a direction of the first end portion of said waveguide.

4. The microwave antenna as claimed in claim 3, wherein the step profile has a number of steps in a range of from 3 to 10, or from 4 to 6.

5. The microwave antenna as claimed in claim 1, wherein said feed is configured to illuminate said antenna array with and/or to receive microwave radiation from said antenna array, said microwave radiation having one or two different polarizations, the one or two different polarizations including linear polarizations, circular polarizations, or elliptical polarizations.

6. The microwave antenna as claimed in claim 5, further comprising a feed control unit configured to control said feed to illuminate said antenna array with and/or to receive microwave radiation having a predetermined polarization from said antenna array.

7. The microwave antenna as claimed in claim 1, wherein said optically controllable semiconductor element is configured to switch the material properties between operation as a conductor and a dielectric causing a phase change of 180° of a reflected microwave signal in said waveguide.

8. The microwave antenna as claimed in claim 1, wherein said optically controllable semiconductor element is formed as a post arranged between, in particular contacting, two opposing sidewalls of said waveguide.

9. The microwave antenna as claimed in claim 8, wherein a width of said optically controllable semiconductor element is in a range of from 5% to 50% or 10% to 30%, of a width of said waveguide.

10. The microwave antenna as claimed in claim 8 or claim 9, wherein each said antenna element further includes a support element configured to carry said optically controllable semiconductor element and that is arranged adjacent to said optically controllable semiconductor element, between said two opposing sidewalls.

11. The microwave antenna as claimed in claim 2, wherein each said waveguide portion has a rectangular cross section with a width in a range from 50% to 90% and a height in a range from 25% to 40%, of the wavelength of the microwave radiation at the operating frequency.

12. The microwave antenna as claimed in claim 1, wherein said optically controllable semiconductor element is arranged at a distance $d_1$ from the second end portion of said waveguide of substantially a guided quarter wavelength of the microwave radiation at the operating frequency.

13. The microwave antenna as claimed in claim 1, wherein the light transmissive portion of the second end portion of said waveguide takes up a portion of 5% to 75% or of 10% to 50%, of a total end area of the second end portion.

14. The microwave antenna as claimed in claim 1, wherein each said antenna element further includes an antireflection element arranged on one or both sides of said optically controllable semiconductor element and having a thickness of substantially a quarter wavelength of the microwave radiation at the operating frequency.

15. The microwave antenna as claimed in claim 1, wherein each said antenna element further includes an aperture element arranged in front of the first end portion of said waveguide and having an aperture larger than an aperture of the first end portion.

16. The microwave antenna as claimed in claim 1, wherein each said antenna element further includes a waveguide to microstrip transition and a microstrip line, and wherein said optically controllable semiconductor element is arranged in the microstrip line.

17. The microwave antenna as claimed in claim 1, wherein said optically controllable semiconductor elements of said antenna array are formed in a grid made of a semiconductor material in which a plurality of holes have been formed, a post of said semiconductor material remaining between two neighboring holes representing at least one of said optically controllable semiconductor elements.

18. The microwave antenna as claimed in claim 17, wherein said waveguides of said antenna array are formed by an array of tubes having two open ends, said array of tubes being coupled to said grid such that an open end of each said tube covers two neighboring holes of said plurality of holes and one of said posts is remaining between said two neighboring holes.

19. The microwave antenna as claimed in claim 1, wherein said controllable light source is formed by a laser diode or a light emitting diode.

20. The microwave antenna as claimed in claim 1, wherein said controllable light sources of said antenna array are arranged in a light source matrix, said light source matrix comprising column and row control lines to individually control said controllable light sources.

21. The microwave antenna as claimed in claim 1, further comprising a control circuit including a control unit per said controllable light source or per a group of said controllable light sources configured to control said controllable light sources of said antenna array, each said control unit having a switchable element coupled in parallel to said controllable light source and a switching element to switch said switchable element on and off under control of a switching element control signal.

22. The microwave antenna as claimed in claim 21, wherein said switchable element is formed by a thyristor or a triac, and wherein said switching element is formed by a diode.

23. The microwave antenna as claimed in claim 21, wherein said controllable light sources of said antenna array are arranged in a light source matrix, and wherein said control circuit further includes a line switch per column or row of said light source matrix to switch a line current provided to a column or row of said controllable light sources coupled in series on and off under control of a line control signal.

24. The microwave antenna as claimed in claim 1, wherein the light transmissive portion is an opening.

25. The microwave antenna as claimed in claim 1, wherein the light transmissive portion includes an indium tin oxide layer arranged in front of said controllable light source.

26. An antenna array comprising a plurality of antenna elements, each said antenna element including:

a waveguide to guide microwave radiation at an operating frequency between a first open end portion and a second end portion arranged opposite the first end portion, said second end portion having a light transmissive portion formed in at least a part of the second end portion, two optically controllable semiconductor elements arranged within said waveguide, in front of the light transmissive portion of the second end portion, each said optically controllable semiconductor element being configured to change its material properties under control of incident light, the material properties including reflectivity of microwave radiation at the operating frequency, a controllable light source arranged at or adjacent to the light transmissive portion of the second end portion to project a controlled light beam onto each said optically controllable semiconductor element to control the material properties, and a septum arranged within said waveguide, in front of the light transmissive portion of the second end portion, and separating said waveguide into two waveguide portions, wherein within each said waveguide portion one of said two optically controllable semiconductor elements is arranged.

* * * * *